United States Patent [19]

Yoshida et al.

[11] 4,182,007

[45] Jan. 8, 1980

[54] SLIDE FASTENER STRINGER

[75] Inventors: Hiroshi Yoshida; Kihei Takahashi, both of Uozu; Toyoaki Hayashi, Kurobe, all of Japan

[73] Assignee: Yoshida Kogyo Kabushiki Kaisha, Tokyo, Japan

[21] Appl. No.: 946,123

[22] Filed: Sep. 27, 1978

[30] Foreign Application Priority Data

Oct. 5, 1977 [JP] Japan ..... 52-134165[U]

[51] Int. Cl.[2] ..... A44B 19/00

[52] U.S. Cl. ..... 24/205.16 C

[58] Field of Search ..... 24/205.16 R, 205.16 C, 24/205.13 C, 205.1 C

[56] References Cited

U.S. PATENT DOCUMENTS 3,135,230 6/1964 Warburton ..... 24/205.16 C X 3,768,125 10/1973 Frohlich ..... 24/205.16 C

*Primary Examiner*—Philip C. Kannan

*Attorney, Agent, or Firm*—Bucknam and Archer

[57] ABSTRACT

A slide fastener stringer includes a stringer tape and a series of fastener elements sewn to the tape by means of stitches with upper and lower legs of the elements lying one on each side of the tape. The sewing stitches include a needle thread extending across and over the lower element legs and a looper thread having loops extending through the tape and between adjacent elements, and interlooped with the needle thread at the side of the tape on which the lower element legs are disposed. The looper thread further includes loops extending over the upper element legs and interlaced with the first-named loops of the looper thread at the other side of the tape.

4 Claims, 5 Drawing Figures

SLIDE FASTENER STRINGER

BACKGROUND OF THE INVENTION

1. Field of the Invention

The present invention relates to a slide fastener stringer including a stringer tape supporting thereon coupling elements each having a pair of upper and lower legs sandwiching therebetween a longitudinal edge of the stringer tape.

2. Prior Art

One of the most widely used stitch types is multi-thread chain stitches or "double locked stitches" that include needle and looper threads both having loops that are interlaced and interlooped. Such stitch type has found particular utility for securing slide fastener coupling elements to a stringer tape because the needle and looper threads can be supplied from large-capacity bobbins for continuous sewing operation. It is especially advantageous to mount helically coiled coupling elements on a stringer tape by utilizing the double locked stitches since the loops of the looper thread engage those legs of the elements which are remote from the stringer tape, and are less stretchable than the needle thread. Slide fastener stringers having coiled fastener elements thus fastened are highly resistant to sharp bending, and hence can be coupled with mating stringers with an increased degree of strength against accidental separation.

However, when the double locked stitches are employed to fasten to a stringer tape coupling elements each having a pair of upper and lower legs disposed one on each side of the tape, as shown in FIG. 4 of the accompanying drawings, the fastener stringer can be sharply bent in one direction as a portion of the needle thread which is disposed on one or lower side of the tape has no interlaced or interlooped loops that give a resistance to such bending. Slide fasteners with such stringers intermeshed are liable to split open when subject to bending forces. To eliminate such a difficulty, it has been attempted to include a pair of additional threads interlaced with the needle thread over the element legs on the lower side of the tape as illustrated in FIG. 5 of the accompanying drawings. Addition of such reinforcing threads however is costly and involves complicated sewing operation which must be accomplished by a specially designed sewing machine.

SUMMARY OF THE INVENTION

According to the invention, sewing stitches securing fastener elements to a stringer tape comprise a needle thread extending across and over those element legs which lie on one of the surfaces of the tape, and a looper thread including loops passing through the tape and extending between adjacent elements, the loops being interlooped with the needle thread at said one tape surface. The looper thread further includes loops extending across and over those element legs which lie on the other surface of the tape and interlaced with said first-named loops at said other tape surface.

It is an object of the present invention to provide a slide fastener stringer having a series of coupling elements supported stably and securely on a stringer tape.

It is another object of the present invention to provide a slide fastener stringer which can firmly intermesh with a companion stringer against splitting open when the coupled stringers are bent in either direction and subjected to a lateral pull.

It is still another object of the present invention to provide a slide fastener stringer which can be manufactured less costly.

The above and other objects and advantages of the present invention will become apparent from the following description when taken in conjunction with the accompanying drawings.

DETAILED DESCRIPTION

Figure 4:
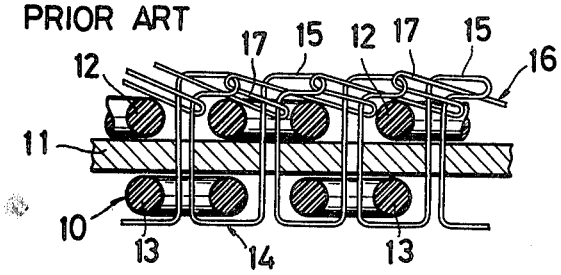
FIG. 4 PRIOR ART
FIG. 4 is a longitudinal cross-sectional view of a conventional slide fastener stringer.
Figure 5:
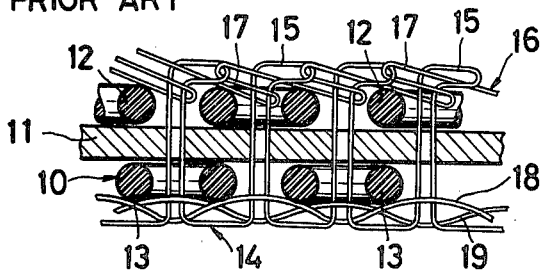
FIG. 5 PRIOR ART
FIG. 5 is a longitudinal cross-sectional view of another conventional slide fastener.

For better understanding of the present invention, the structure of conventional multi-thread chain stitches or "double locked stitches" will be explained with reference to FIGS. 4 and 5. In FIG. 4, a series of filamentary coupling elements 10 are mounted on a longitudinal edge of a slide fastener stringer tape 11 with their upper and lower legs 12, 13 disposed one on each side of the tape 11. The coupling elements 10 are fastened to the tape 11 by the double locked stitches including a needle thread 14 retaining the lower legs 13 and passing between the lower legs 13 and through the tape 11, the needle thread 14 having loops 15 disposed on the upper legs 12. The stitches also include a looper thread 16 extending across and over the upper legs 12 and having loops 17 interlaced and interlooped with the loops 15 of the needle thread 14. FIG. 5 illustrates a pair of additional threads 18, 19 extending across and over the lower legs 13 and interlaced with the needle thread 14 so as to prevent excessive bending of a slide fastener stringer.

Figure 1:
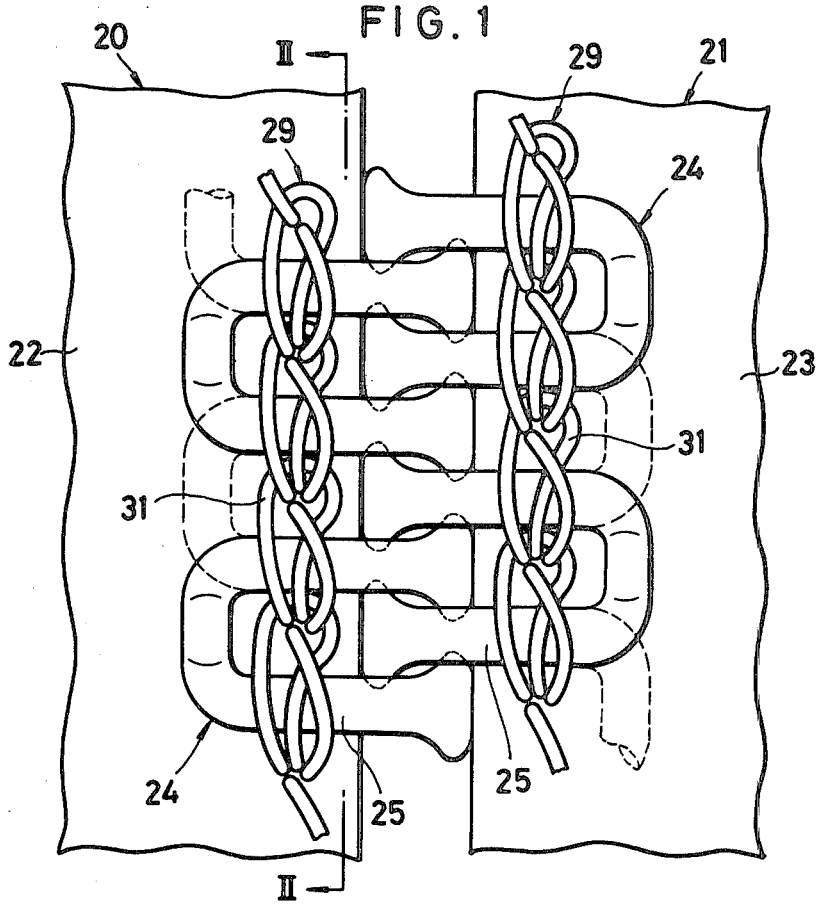
FIG. 1 is a fragmentary enlarged front view of a pair of slide fastener stringers constructed in accordance with the present invention.
Figure 2:
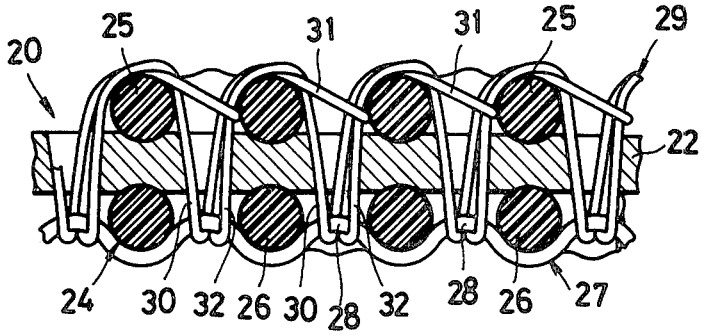
FIG. 2 is a cross-sectional view taken along line II—II of FIG. 1.
Figure 3:
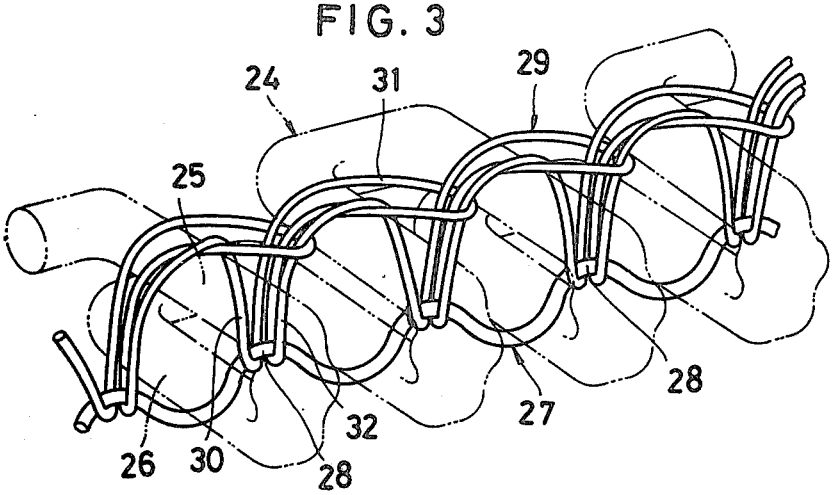
FIG. 3 is a perspective view of sewing stitches as engaging fastener elements.

The invention will now be described in detail with reference to FIGS. 1 through 3. As shown in FIG. 1, a pair of slide fastener stringers 20, 21 have a pair of stringer tapes 22, 23, respectively, each supporting on and along its one longitudinal edge a series of filamentary coupling elements 24 in the form of a meander or zigzag having the cross-sectional shape of a U, and secured to the tape 22, 23 by means of sewing stitches that are a modification of multi-thread chain stitches or "double locked stitches". In FIGS. 2 and 3, each of the coupling elements 24 includes a pair of upper and lower legs 25, 26 disposed respectively on th upper and lower sides or surfaces of the stringer tape 22. The sewing stitches include a needle thread 27 extending across and over the lower legs 26 of the elements 24 and having a plurality of loops 28 disposed between every adjacent two of the lower legs 26. Such loops 28 are held out of contact with the lower surface of the tape 22 and, therefore, the needle thread 27 runs with a relatively small degree of tortuosity, engaging only a peripheral portion of each lower leg 26 which is remote from the stringer tape 22.

The sewing stitches further include a looper thread 29 extending across and around the upper legs 25 of the elements 24 and having a chain of loop units each comprising three loops 30, 31 and 32. The loop 30 extends between adjacent two of the upper legs 25 and through the stringer tape 22, and is interlooped with one of the loops 28 of the needle thread 27. One end of the loop 30 blends into the loop 31 which is disposed over one of the upper legs 25 of the elements 24, the loop 31 having one end blending into the loop 32 which passes through the tape 22 and is interlooped with the needle thread loop 28 that is the one with which said loop 30 is interlooped. The other end of the loop 32 blends into a preceding one of the loops 30. The loop 31 is interlaced with and bundles the previous loops 30 and 32.

Such an arrangement of the needle and looper threads 27, 29 can be achieved by maintaining the needle thread 27 under more tension than normal when the coupling elements 24 are sewn on a sewing machine for multi-thread chain stitching.

To assist the needle thread 27 in running less tortuously, the needle thread 27 should preferably be thicker or more rigid than the looper thread 29. For example, the needle thread 27 may be of a flattened cross-sectional shape or comprise a plurality of stranded yarns. Further, it is preferable for the needle thread 27 to have a greater coefficient of thermal contraction than the looper thread 29 such that the needle thread 27 can shrink to a greater degree than the looper thread 29 when the slide fastener stringer 20, 21 is subjected to heat setting.

With this arrangement, the upper and lower legs 25, 26 of the coupling elements 24 are held stably in position respectively by the looper thread 29 extending tightly around the upper legs 25 and the needle thread 27 interlooped with the looper thread 29 between adjacent lower legs 26. Further, the slide fastener stringer 20, 21 has a relatively large degree of resistance to sharp bending because the needle thread 27 that is less tortuous and the loops 31 that bundle the loops 30, 32 of the looper thread 29 act against any forces tending to bend or fold the stringer 20, 21. Accordingly, a slide fastener having the intermeshed stringers 20, 21 of the invention is less liable to split open when subjected to bending forces. The slide fastener stringer 20, 21 can be manufactured easily and inexpensively since it includes no additional thread or requires no special sewing machine.

Although the specific embodiment has been described in detail, it should be understood that various changes and modifications may be made therein without departing from the scope of the appended claims. For example, the sewing stitches of the invention can be used to secure other types of fastener elements than disclosed above, such for instance as discrete fastener elements formed by injection molding or extrusion molding and each composed of a pair of upper and lower legs, the elements being connected together by means of strings or filaments that join the element legs.

We claim as our invention:

1. A slide fastener stringer comprising:

(a) a stringer tape having a pair of opposite surfaces along its one longitudinal edge;

(b) a series of fastener elements each having a pair of spaced legs disposed respectively on said surfaces and sandwiching said longitudinal edge therebetween; and (c) sewing stitches securing said fastener elements to said stringer tape, said sewing stitches being composed of a needle thread and a looper thread, said needle thread extending across and over those element legs which lie on one of said tape surfaces, said looper thread including loops passing through said tape and extending between adjacent elements, said loops being interlooped with said needle thread at said one tape surface, said looper thread further including loops extending across and over those element legs which lie on the other tape surface and interlaced with said first-named loops at said other tape surface.

2. A slide fastener stringer according to claim 1, said needle thread being thicker than said looped thread.

3. A slide fastener stringer according to claim 1, said needle thread being more rigid than said looper thread.

4. A slide fastener stringer according to claim 1, said needle thread having a greater coefficient of thermal contraction than said looper thread.

* * * * *